US005311975A

United States Patent [19]

Hiortdahl

[11] Patent Number: 5,311,975

[45] Date of Patent: May 17, 1994

[54] COIN SLIDE EXTENSION

[75] Inventor: John C. Hiortdahl, Lothian, Md.

[73] Assignee: Hof Service Company, Inc., Silver Spring, Md.

[21] Appl. No.: 854,690

[22] Filed: Mar. 20, 1992

[51] Int. Cl.[5] ..... G07F 5/06

[52] U.S. Cl. ..... 194/235; 194/343

[58] Field of Search ..... 194/204, 243, 259, 253, 194/235, 238, 343, 241, 228, 342; 221/245

[56] References Cited

U.S. PATENT DOCUMENTS

| | | | |
|---|---|---|---|
| 2,008,926 | 7/1935 | Rowe | 221/245 X |
| 2,102,372 | 12/1937 | Mills | 194/243 X |
| 2,810,798 | 10/1957 | Taylor | 194/243 |
| 2,947,186 | 8/1960 | Greenwald | 194/343 X |
| 3,185,279 | 5/1965 | Spears | 194/243 |
| 3,231,059 | 1/1966 | Hall | 194/238 |
| 3,872,958 | 3/1975 | Greenwald et al. . | |
| 3,990,318 | 11/1976 | Cahoe et al. | 194/241 X |
| 4,131,190 | 12/1978 | Gitlin . | |
| 4,193,488 | 3/1980 | Baum | 194/343 |
| 4,350,240 | 9/1982 | Gitlin et al. . | |
| 4,502,584 | 3/1985 | Lambiris . | |
| 4,515,262 | 5/1985 | Wilfong et al. . | |
| 4,588,064 | 5/1986 | Monfredi . | |
| 4,651,861 | 3/1987 | Lambiris . | |
| 4,828,096 | 5/1989 | Gitlin et al. . | |
| 5,074,396 | 12/1991 | Gitlin et al. . | |

*Primary Examiner*—F. J. Bartuska

*Attorney, Agent, or Firm*—Roylance, Abrams, Berdo & Goodman

[57] ABSTRACT

A coin slide extension for a coin chute assembly. A pivotal lever is connected to a mounting bracket secured to the end of an extension plate. The lever pivots over a starting mechanism upon inward movement of the coin slide, and operatively engages the starting mechanism upon outward movement. The lever abuts a stop during outward movement to prevent the lever from pivoting over the starting mechanism. In an alternative embodiment, an extension plate has two spaced apart contact legs between which a reciprocating lever of a ratchet mechanism is disposed. One leg moves the reciprocating lever to a ready position and the other moves it to an activation position.

26 Claims, 6 Drawing Sheets

COIN SLIDE EXTENSION

FIELD OF THE INVENTION

The present invention relates generally to an improved coin slide extension assembly of a control unit for a coin operated apparatus. More particularly, the invention relates to a pivotal activation finger in one embodiment, and a pair of spaced apart contact fingers in another embodiment, both of which lengthen the engage-to-start stroke and thus make it more difficult for a tampering customer to obtain a free start.

BACKGROUND OF THE INVENTION

A coin chute assembly may typically include a stationary housing having a horizontally oriented guide track, a vertically oriented mounting plate and a baffle positioned over a set of blocking dogs. A coin slide is slidably mounted in the guide track of the housing to move into and retract from the housing. Slots provided in the upper surface of the coin slide support a requisite number and denomination of coins in a vertical, longitudinally oriented position. Without the coins, the coin slide is prevented from moving inwardly beyond a point where the blocking dogs catch a bar mounted on the coin slide. The coins coact with a sizing block mounted in a forward end of the baffle to push the blocking dogs downwardly, thus facilitating further inward movement of the coin slide. Eventually, a fixed finger of an extension mounted on the coin slide engages an "on" switch timer or other structure provided for activation of the machine.

After the coins pass under the sizing block, a pawl mounted in the side of the coin slide comes into cooperative engagement with a rack mounted on the side of the guide track. The pawl and rack provide a ratchet mechanism that prevents the coin slide from being retracted until after the coin slide moves inwardly to a point where the coins fall into a coin box.

Generally, at the point where the coin slide is extended far enough to engage the start mechanism of the associated machine, such as a dryer, washer, vending machine, etc., the coins have not yet dropped through the slots in the coin slide and into the coin box. At this point, a tampering customer can pry backwards on the handle of the coin slide, using the top edge of the meter case or "shoe-box" for leverage. After prying with sufficient force, the coin slide pawl is damaged or broken so that the coin slide can be freely reciprocated. Once this occurs, the "customer" can receive a free start by pushing the coin slide inwardly sufficiently to activate the machine, without reaching the point where the coins fall into the coin box. Then, the coin slide is retracted to retrieve the coins.

Generally, the amount of coin slide travel necessary to effect activation of the machine is relatively slight. Once the ratchet mechanism is broken or otherwise disarmed, the tampering customer can leave the coin slide in, even after discharge of the coins into the coin box, and start the machine by reciprocating the coin slide in and out a relatively short distance. As long as the coin slide is not retracted far enough to re-engage the blocking dogs, free starting can occur indefinitely. This problem is at least partly attributable to the generally short "engage-to-start" stroke of the slide extension. Normally, the activation finger is fixed and need only contact a timer or switch mechanism for a relatively short travel distance of the coin slide.

A coin chute assembly having the aforementioned features including the coin slide and blocking dogs is described in U.S. Pat. No. 4,502,584 to Lambiris. A coin slide extension assembly capable of use on the coin slide of the Lambiris patent is found in U.S. Pat. No. 3,872,958 to Greenwald et al. Both of these patents are incorporated herein by reference. Other U.S. patents describing general features of coin slides and anti-tampering mechanisms include U.S. Pat. Nos. 2,947,186 to Greenwald; 4,131,190 to Gitlin; 4,588,064 to Monfredi 4,651,861 to Lambiris; 4,828,096 to Gitlin et al; and 5,074,396 to Gitlin et al, the disclosures of which are also incorporated herein by reference.

SUMMARY OF THE INVENTION

Accordingly, it is a primary object of the present invention to provide an improved coin slide extension assembly capable of extending the length of the engage-to-start stroke necessary to engage a starting mechanism and thereby start a coin-operated machine.

Another object of the present invention is to provide an improved coin slide extension assembly capable of preventing or making it more difficult for a tampering customer to obtain a free start.

Still another object of the present invention is to provide a coin slide extension assembly which is relatively simple in construction and cost effective to produce.

These and other objects are basically met by providing a slide extension for a coin control unit having a housing, a starting mechanism disposed within the housing, and a coin slide mounted in and extending outwardly from the housing, the coin slide being movable inwardly to an innermost position and outwardly to an outermost position, the slide extension including means for operatively engaging the starting mechanism during outward movement of the coin slide after the coin slide moves inwardly a predetermined distance and means for connecting said engaging means to the coin slide.

In one embodiment, the engaging means includes a pivoting lever which is free to pivot over the starting mechanism upon inward movement of the coin slide, and is prevented from pivoting more than a certain amount by a stop during outward movement, thereby operatively engaging the starting mechanism upon outward movement of the coin slide.

In another embodiment, the engaging means includes a bracket having two spaced apart contact legs, one moving a starting mechanism to a ready position with inward movement of the coin slide and the other moving the starting mechanism to an activation position with movement of the coin slide in the opposite outward direction.

Other objects, advantages and salient features of the invention will become apparent from the following detailed description, which, taken in conjunction with the annexed drawings, discloses preferred embodiments of the invention.

BRIEF DESCRIPTION OF THE INVENTION

Figure 13:
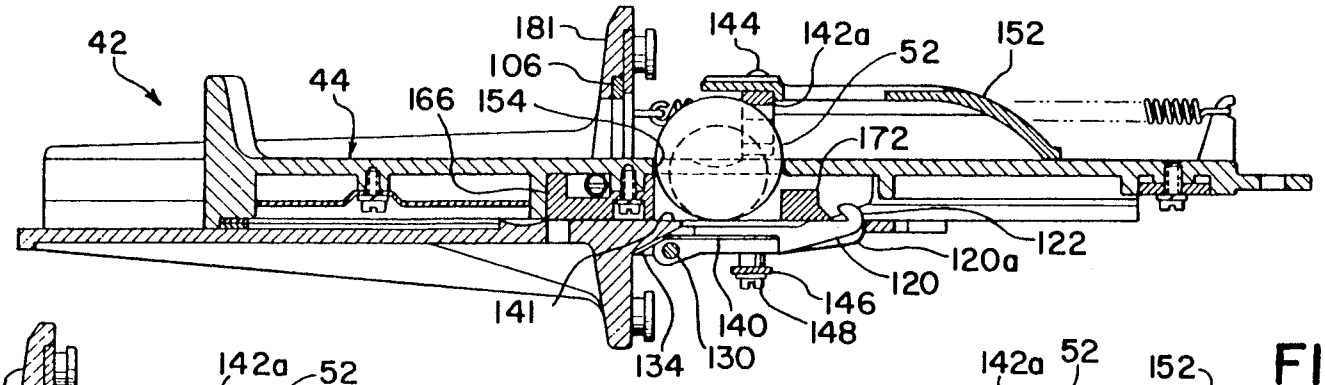
FIG. 13 is a sectional view similar to FIG. 12 with the coin slide advanced inwardly in the direction of its inserted position, and with the coin carried past a gate in the coin chute housing and ready to engage with the coin sizing subassembly.
Figure 15:
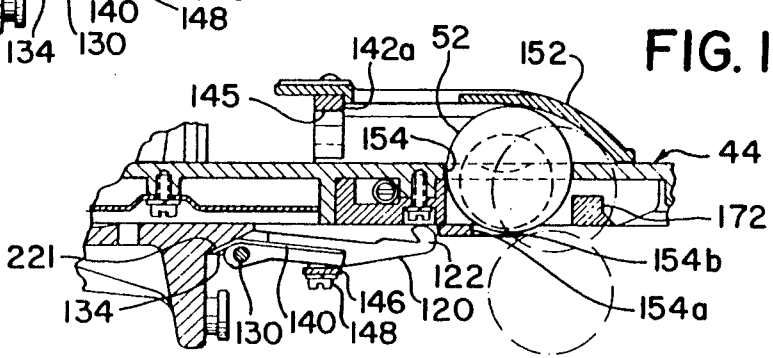
Figure 14:
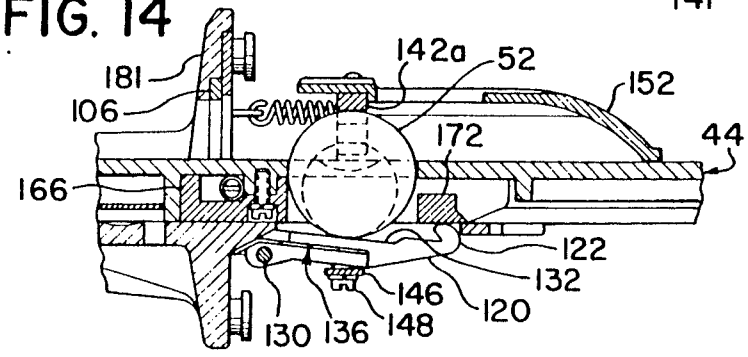

FIG. 14 is a partial sectional view similar to FIG. 13 with the coin in engagement with the coin sizing subassembly thereby to move the blocking dog to its displaced non-blocking position to permit continued movement of the coin slide to its inwardly inserted position; and FIG. 15 is a partial sectional view similar to FIG. 14 with the coin slide moved further inwardly in the direction of its inserted position, and showing the sequential positioning of the coin as it exits from the coin chute assembly.

DETAILED DESCRIPTION OF THE PREFERRED EMBODIMENTS

Figure 3:
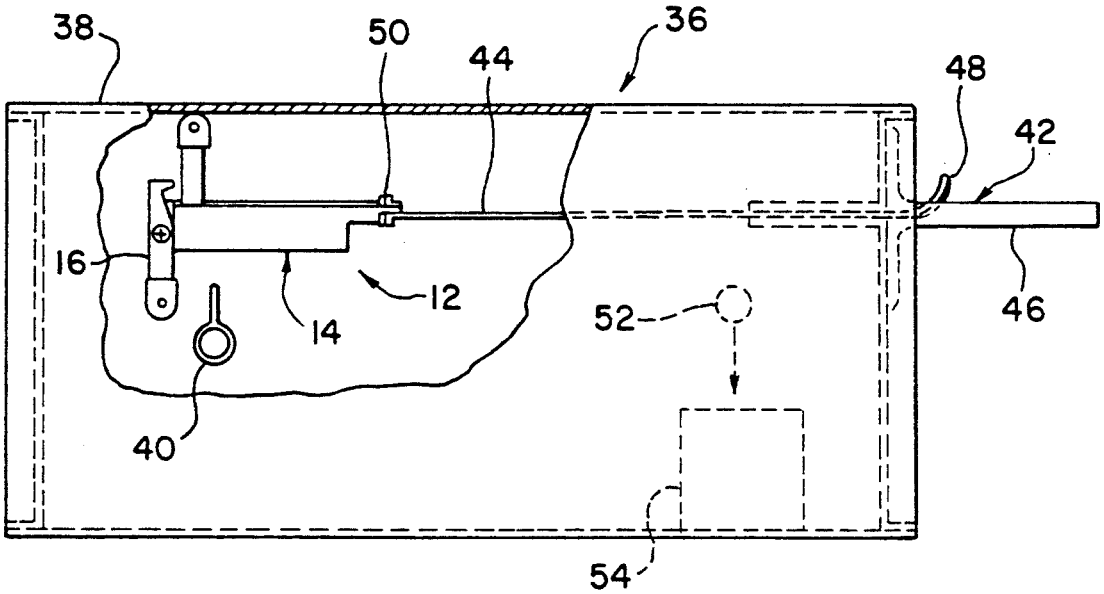
FIG. 3 is a side elevational view similar to FIG. 1, with the coin slide pushed inwardly to an innermost position.
Figure 4:
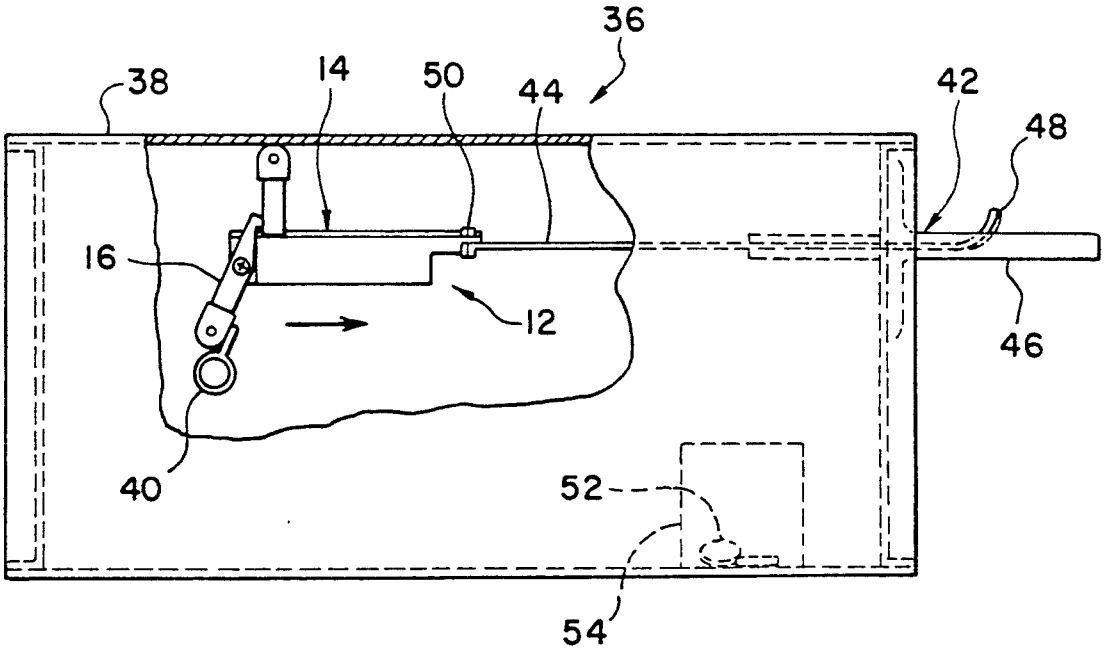
FIG. 4 is a side elevational view similar to FIG. 1, with the coin slide retracted from the innermost position to a position where the pivoting lever operatively engages the starting mechanism.
Figure 5:
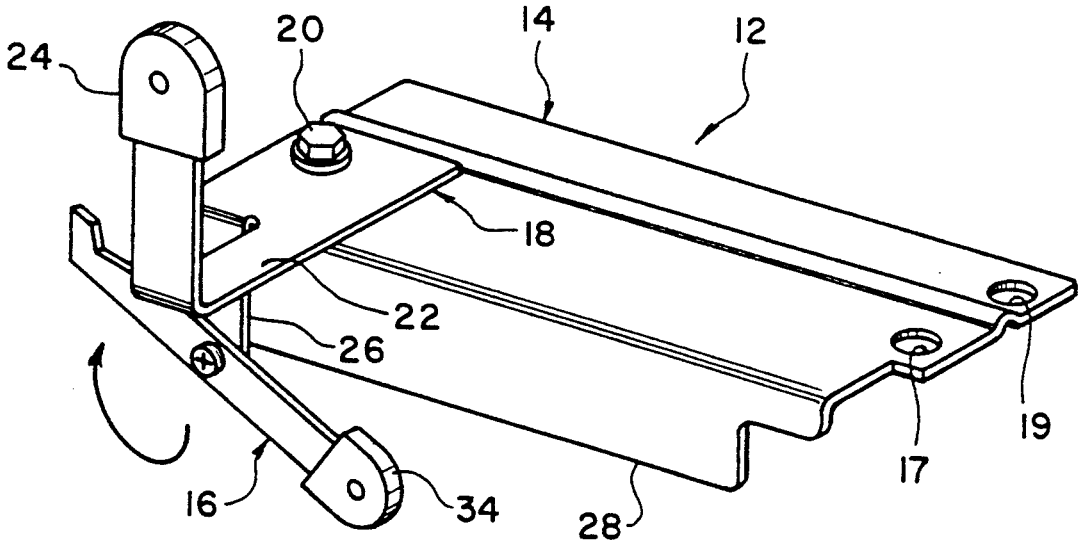
FIG. 5 is an enlarged perspective view of the slide extension assembly of FIG. 1 with the pivoting lever tilted for clarity.

Referring now to FIGS. 1-7, a slide extension assembly 12 includes an extension plate 14, a pivotal lever 16 and a mounting bracket 18. The extension plate 14 has two mounting holes 17 and 19 for detachably coupling the extension plate 14 to an inner end of a coin slide. As seen in FIG. 5, a threaded fastener 20 secures the mounting bracket 18 to a distal end of the extension plate 14. The mounting bracket 18 includes an L-shaped leg 22 having a horizontal portion extending transversely outwardly from a side edge of the extension plate 14. A vertical portion of the leg 22 extends upwardly from and forms a right angle with the horizontal portion. A distal end of the vertical portion is fitted with a plastic cap 24 made of low frictional coefficient plastic material. The cap 24 provides at its apex a sliding contact surface which engages an interior surface of the housing 38.

Figure 6:
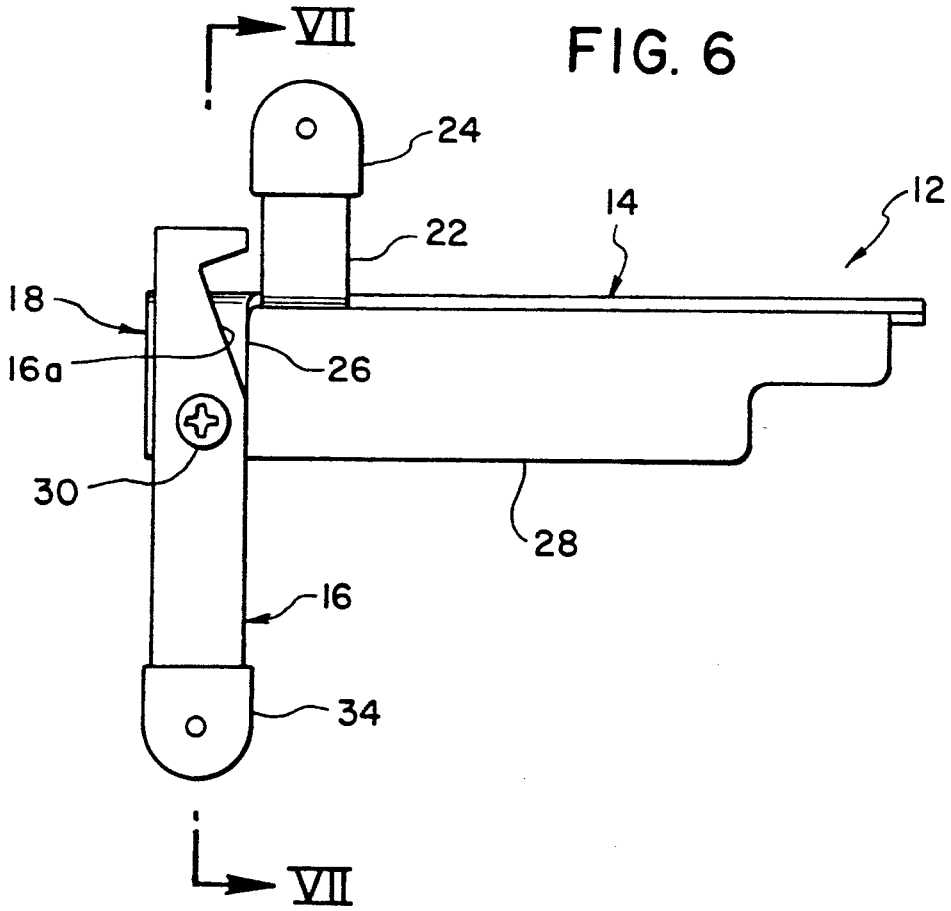
FIG. 6 is a side elevational view of the slide extension assembly of FIG. 5 with the pivoting lever in its vertical, rest position.
Figure 7:
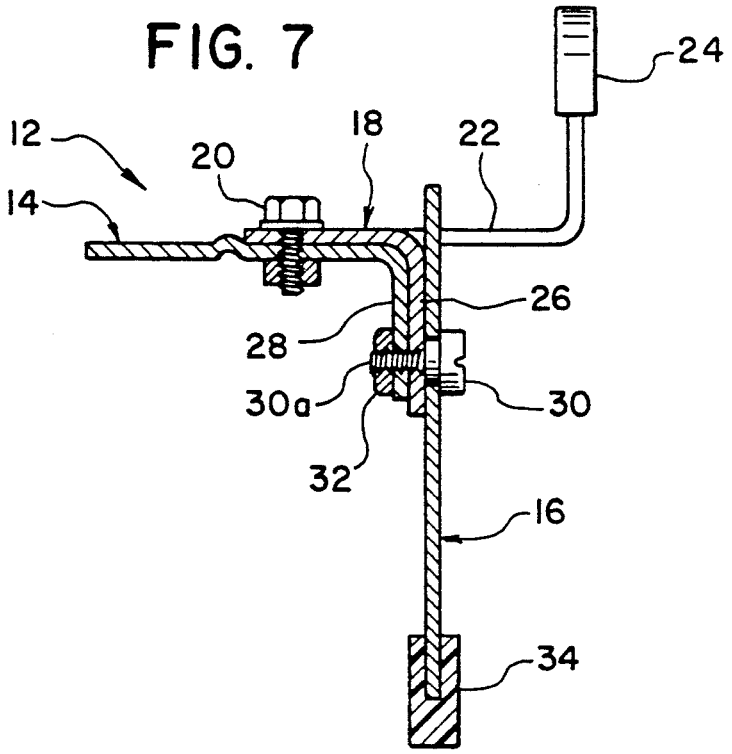
FIG. 7 is a transverse vertical sectional view taken along line VII—VII of FIG. 6.

The mounting bracket 18 further includes a second leg 26, as best seen in FIGS. 5-7, extending downwardly parallel with and juxtaposed against a stiffening flange 28 of the extension plate 14. The leg 26 is parallel to but spaced inwardly from the vertical portion of leg 22. As shown in FIG. 7, a shoulder bolt 30 passes through aligned mounting holes formed in the lever 16, the leg 26 and the flange 28. A threaded shank portion 30*a* of the shoulder bolt 30 engages a nut 32 to tighten an end face of the shoulder portion of the bolt 30 against an outer surface of the leg 26. The lever 16 thus pivots between the outer surface of leg 26 and the inner surface of the head portion of the shoulder bolt 30. A cap 34 is fitted on the lower end of the lever 16, and is preferably made of low frictional coefficient plastic material so as to reduce frictional wear between the lever 16 and a pivotal starting mechanism 40. The lever 16 is free to pivot at least 90° when pivoting counter-clockwise as seen in FIG. 5, but is prevented from pivoting a few degrees beyond vertical when pivoting clockwise, as seen in FIG. 4, due to the upper portion of the lever 16 abutting the horizontal portion of the leg 22, which forms a stop.

Referring to FIGS. 1-4, a coin control unit 36 includes a box-shaped housing 38 which encloses the conventional pivotal starting mechanism 40. The starting mechanism 40 activates a machine, such as a washer, dryer, lighting system, pool game, or other coin-operated device when moved to an activation position by the coin slide 44. A coin chute assembly 42 includes the coin slide 44, which reciprocates in a stationary guide track 46. An outer end of the coin slide 44 includes a handle, while the inner end has mounting holes which align with the mounting holes 17 and 19 (FIG. 5) of the extension plate 14. The extension plate 14 is thus mounted to the inner end of the coin slide 44 with threaded fasteners 50 passing through the holes 17 and 19.

ASSEMBLY AND OPERATION

Figure 1:
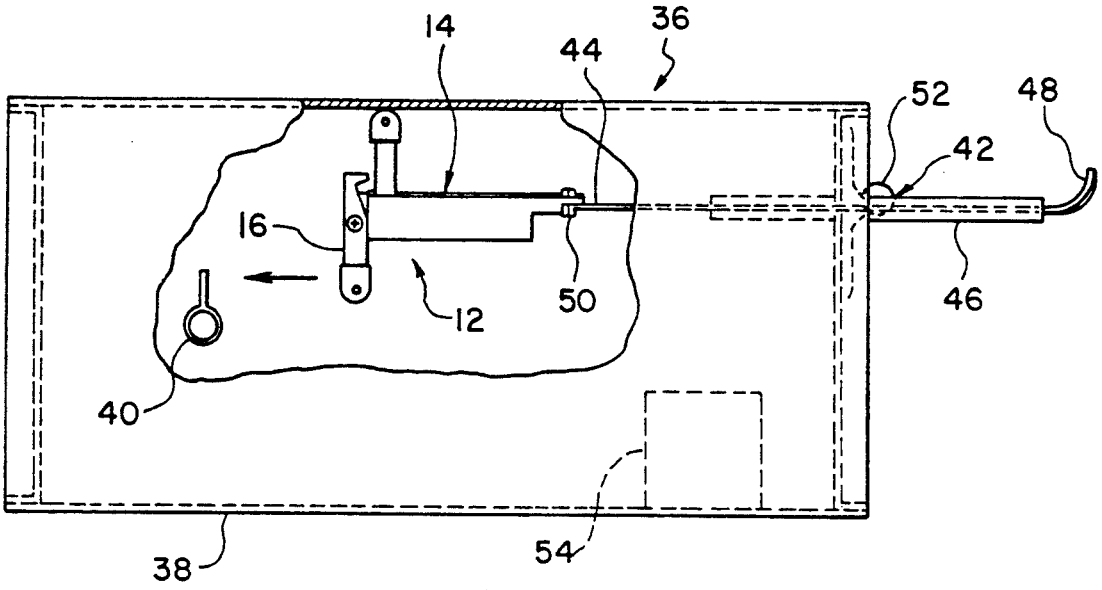
FIG. 1 is a side elevational view of a coin operated apparatus, partly in section and partially cut away, showing the improved slide extension assembly of the present invention, with the coin slide in an initial, outermost position.

In FIG. 1, the coin slide 44 is illustrated in its outermost, initial position. In order to start the associated machine, such as a washer or dryer, a coin or coins 52 are placed in coin slots provided in the coin slide 44. Details of the coin chute assembly 42 have been omitted since its operation is well known in the art. Accordingly, only certain parts of the coin chute assembly 42 will be discussed below and illustrated in FIGS. 12-15. The coin chute assembly is described in detail in the aforementioned U.S. Pat. No. 4,502,584 to Lambiris. As the coin slide 44 is pushed inwardly, a set of blocking dogs 120 are disengaged by the coins 52 in a manner described in detail in the Lambiris patent. Prior to contacting the starting mechanism 40, the pivoting lever 16 is oriented vertically as in FIG. 1 by the force of gravity.

Figure 2:
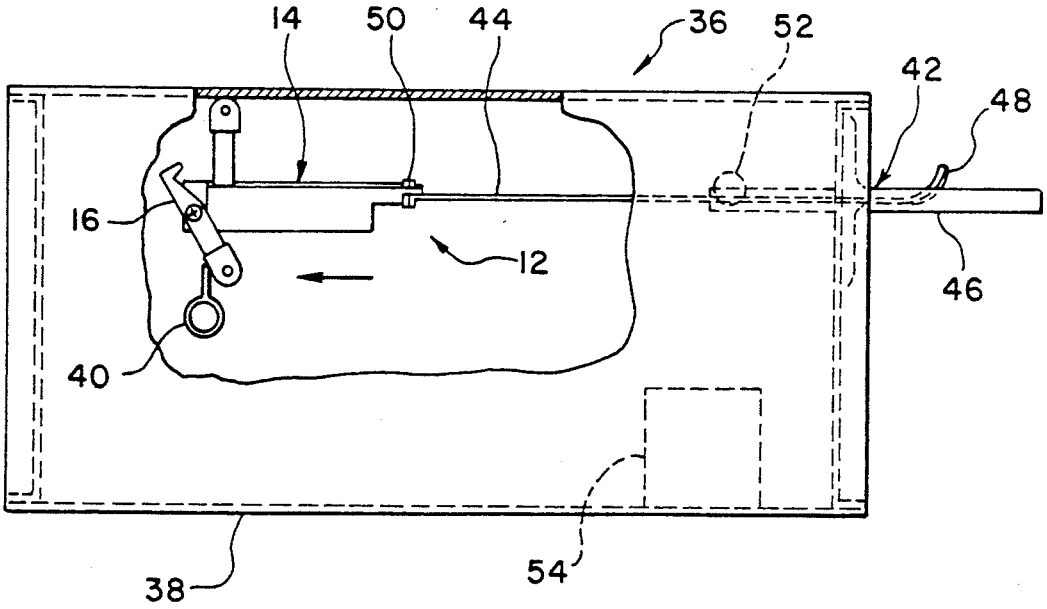
FIG. 2 is a side elevational view similar to FIG. 1 with the coin slide pushed inwardly to a position where a pivoting lever pivots over a starting mechanism.

As shown in FIG. 2, the starting mechanism 40 extends into the path of the lever 16. However, since the lever 16 is pivotally coupled, contact between the lever 16 and the starting mechanism 40 imparts pivotal motion in the lever 16 in the counter-clockwise direction as the coin slide advances inwardly. Thus, as the coin slide 16 is pushed inwardly, the lever 16 pivots over the starting mechanism without operatively engaging same.

As shown in FIG. 3, at or near the innermost position of the coin slide 44, the lever 16 has cleared the starting mechanism 40 and has pivoted back to the vertical position by gravity. The coins 52 fall through mounting slots in the coin slide, after passing the end of the guide track 46, and into an open upper end of a coin box 54. Then, as shown in FIG. 4, as the coin slide 44 is retracted, the lever 16 bears against the starting mechanism 40 and is thus caused to pivot clockwise through a limited range of lost angular motion. Eventually, the upper portion of the lever 16 comes into abutment with the horizontal portion of the leg 22, which forms a stop to prevent further pivoting motion. A step 16*a* (FIG. 6) formed in the upper portion of the lever 16 ensures that the lever 16 will pivot beyond vertical so that the starting mechanism 40 is not moved to a start or "on" position until the coin slide 46 is well into its retraction or outward stroke. The overall effect is to lengthen the engage-to-start stroke to include most, if not all, of the inward movement of the coin slide 44 and at least part of the outward movement.

The starting mechanism 40 cannot be activated until after the coin slide 44 has moved inwardly to a predetermined position and then outwardly to a predetermined position. The predetermined inward position may be in proximity to the position where the coins 52 drop through their coin slots, as seen in FIG. 3. The predetermined outward position is preferably not reached until the coin slide 44 is retracted to a point where the blocking dogs have moved back to a blocking position to prevent further inward movement. Thus, even if tampering disarms the ratchet mechanism, which normally prevents retraction of the coin slide 44 until after the coins are discharged, the engage-to-start stroke now requires insertion and then retraction to a position where the blocking dogs prevent further insertion unless more coins are added to the coin slide 44. This position corresponds approximately to that shown in FIGS. 2 and 4. After the starting mechanism 40 is moved to the activation position, it can either pivot clockwise back to its initial position or counter-clockwise. If the starting mechanism moves counter-clockwise, the coin slide 44 must move the lever 16 sufficiently outwardly to permit the lever 16 to clear the starting mechanism 40.

Other sizes and shapes of levers 16 may be employed. Moreover, leg portion 22 could be omitted if a guide leg is not required. Also, the mounting bracket 18 could be omitted so that the lever could be pivotally connected directly to the flange 28. If the coin slide 44 were of sufficient length, the extension plate 14 could be left out and the lever 16 could be pivotally connected directly to the coin slide 44.

THE EMBODIMENT OF FIGS. 8–11

Figure 8:
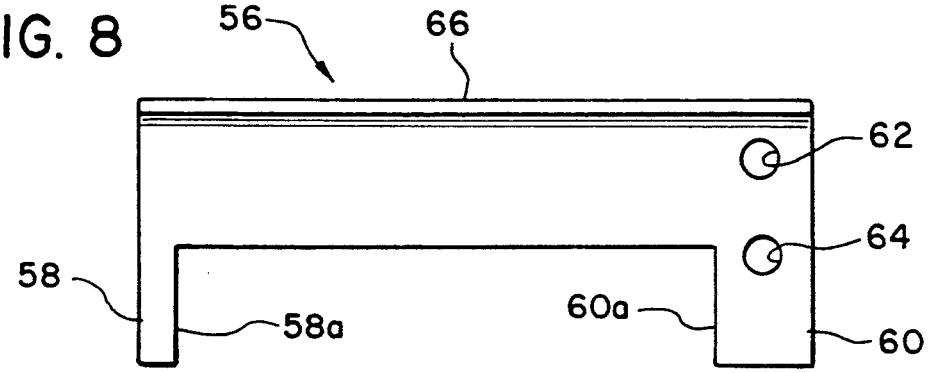
FIG. 8 is a top plan view of a slide extension according to another embodiment of the present invention.
Figure 9:
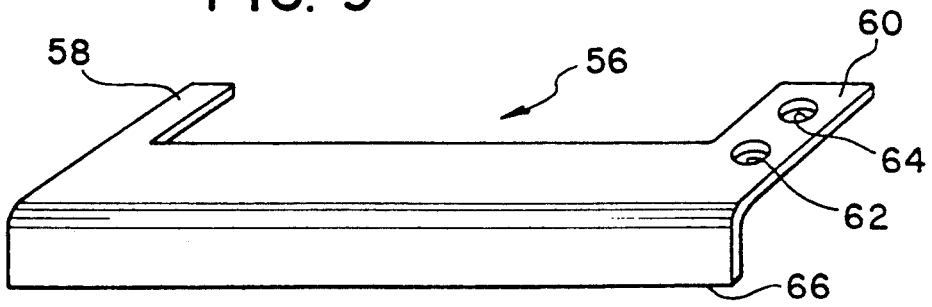
FIG. 9 is a perspective view of the slide extension of FIG. 8.

Referring to FIGS. 8 and 9, an extension plate 56 of a second embodiment of the present invention includes two parallel, spaced apart, transversely extending contact legs 58 and 60, each having an inner edge 58*a* and 60*a*, respectively. The legs 58 and 60 give the plate 56 a substantially U-shaped profile. A pair of mounting holes 62 and 64 provided in the leg 60 align with the mounting holes of the coin slide 44, as in the previous embodiment. A stiffening flange 66 is formed on one longitudinal side of the extension plate 56.

Figure 10:
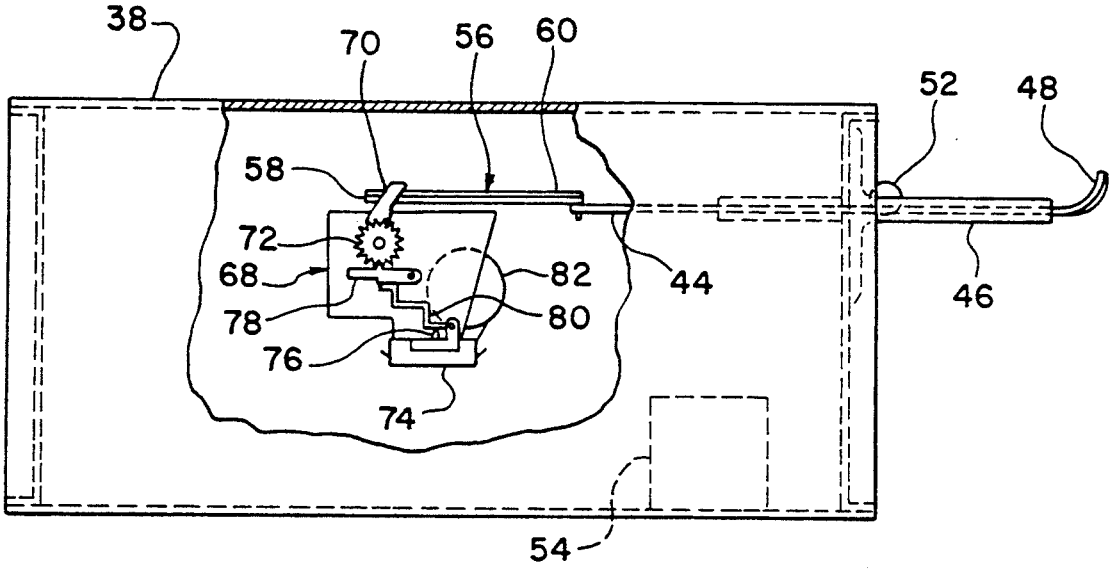
FIG. 10 is a side elevational view, partially in section and partially cut away, illustrating a coin operated apparatus employing the second embodiment of the coin slide extension according to the present invention shown in FIGS. 8-9, with the coin slide in an activation position.
Figure 11:
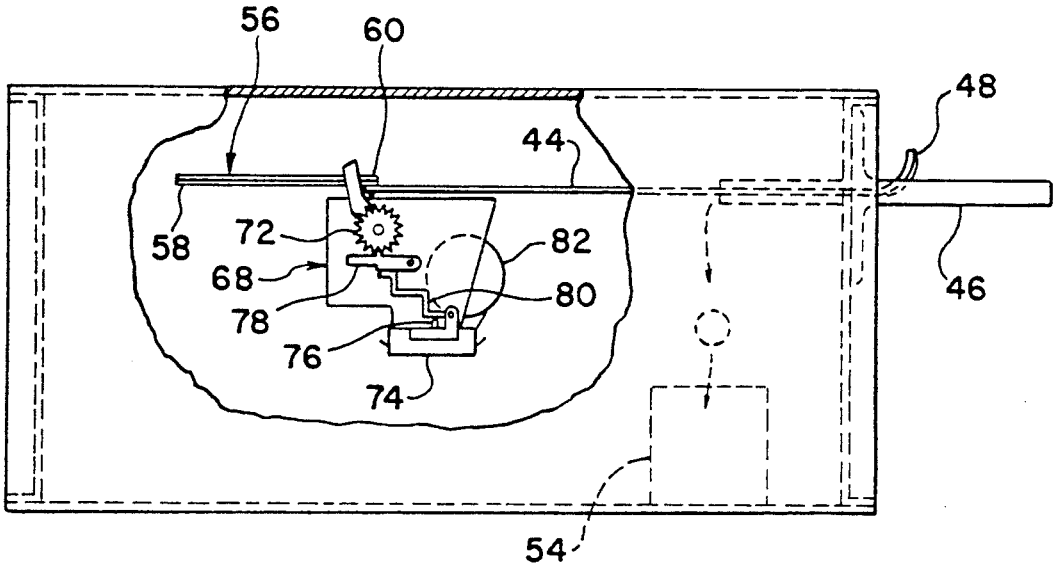
FIG. 11 is a side elevational view similar to FIG. 10, but with the coin slide pushed inwardly to move the starting mechanism to a "ready position"

As shown in FIG. 10, a starting mechanism 68 of a conventional ratchet-type replaces starting mechanism 40 of the previous embodiment, but is housed in the same housing 38. The extension plate 56 is coupled to the coin slide 44 as before. A reciprocating lever 70, operatively coupled to a ratchet wheel 72, extends upwardly between the two legs 58 and 60. In the initial, outermost position of the coin slide 44 of FIG. 10, the lever 70 abuts the inner edge 58*a* (FIG. 8) of the second leg 58 and coins 52 are loaded in the coin slots. The coin slide 44 is then pushed inwardly to a position sufficient to permit the coins or coin 52 to fall into the coin box 54, as seen in FIG. 11. During this inward motion, the inner edge 60*a* of the first leg 60 comes into abutment with one side of the reciprocating lever 70. Further inward motion causes the lever 70 to pivot counter-clockwise. A pawl (not shown) of the lever 70 permits counter-clockwise rotation of lever 70 without concomitant rotation of the ratchet wheel 72. The ratchet wheel pivots with the lever 70 in the clockwise direction due to the ratchet pawl in the usual fashion.

A switch 74 includes a push button 76 which is pushed downwardly when the ratchet wheel 72 is pivoted in the clockwise direction. The teeth of the ratchet wheel engage a protrusion formed on a pivotally mounted lever 78. The lever 78 is pivotally mounted under the ratchet wheel 72 and is caused to pivot downwardly by the wheel 72. A lever 80 pivotally connected to the switch 74 pivots downwardly in response to downward pivotal movement of the lever 78 to push the push button 76 and thus activate or turn "on" the switch 74. A timer mechanism 82 is operatively coupled to the switch 74 to turn the switch "off" after a predetermined length of time. The timer mechanism 82 rotates the ratchet wheel independently of the lever 70.

Since the ratchet wheel 72 cannot be rotated clockwise until the lever 70 is moved counter-clockwise, the engage-to-start stroke requires inward motion of the coin slide 44 and then retraction. The inward motion moves the lever 70 via leg 60 to a ready or return position illustrated in FIG. 11, while the outward motion moves the lever 70 via leg 58 to the activation position illustrated in FIG. 10. Once the starting mechanism 68 is activated, the coin slide 44 cannot be pushed inwardly again unless coins are re-loaded in the coin slots. If the pawl of the coin slide is broken by prying such that the coin slide 44 can be reciprocated, the length of the engage-to-start stroke prevents free starting because the blocking dogs of the coin chute assembly will re-engage to prevent further inward movement. In other words, at the point where the switch 74 is turned on, the coin slide will be retracted to a position where the blocking dogs will prevent further inward movement until additional coins are loaded in the coin slots.

COIN CHUTE ASSEMBLY 42

In order to prevent full insertion of coin slide 44 when it is not carrying any coins or when the slide is carrying improperly sized coins, a set of blocking dogs 120, such as shown in FIGS. 12–15, is pivotally mounted to the undersurface of housing inner position 221 each having a hook-shaped end portion 122 disposed along guide track 141. The hook end is formed having a shoulder surface 124 which functions as a stop against which an undersurface edge of coin slide 44 abuts when the slide is moved in its inserted direction thereby to limit the extent to which the slide may be inserted without a proper coin 52 in coin support slot 154. The opposite end 126 of blocking dog 120 is provided with an opening 128 sized to loosely receive a pivot pin 130 about which dogs 120 rotates. Intermediate the hook end 122 and the pivotally mounted end 126 is a platform section 132 which defines the upper surface of dog 120. Platform 132 is disposed to lie along the path of travel of a coin 52 upon inserted movement of coin slide 44 as hereinafter described.

Referring to FIGS. 12–15, the blocking dogs 120 are pivotally mounted about the pin 130 suitably supported between a pair of support brackets 134. In the illustrated form of the invention, each of the blocking dogs is aligned with a separate one of the coin support slots 154, and is biased by a spring 136 into a normal blocking position shown in FIG. 12. In such position, the hook-shaped end portion 122 is positioned in the path of travel of coin slide 44, and the engagement of the hardened inner end projection 172 of cover plate 166 with the shoulder surface 124 of any one of the dogs 120 will stop or prevent further inserted movement of the slide, when the slide 44 carries either no coin or an improperly sized coin.

The spring 136 is positioned, as shown in FIGS. 12–15, with head portion 138 held against the undersurface of housing inner portion 221 by the end portion 126 of the dogs 120. The arrangement is such that each of the spring fingers 140 is aligned with and resiliently engages a separate one of the blocking dogs 120 to bias the set of dogs to their blocking position.

The blocking dogs 120 are disposed for movement between the aforesaid normal blocking position and a displaced non-blocking position, as shown in FIGS. 14 and 15, upon inserted movement of coin slide 44 carrying with its properly sized coins 52. In this regard, inserted movement of coin slide 44 causes coins in any of the coin support slots 154 to ride onto the platform 132 of the respective ones of the blocking dogs 120.

Figure 12:
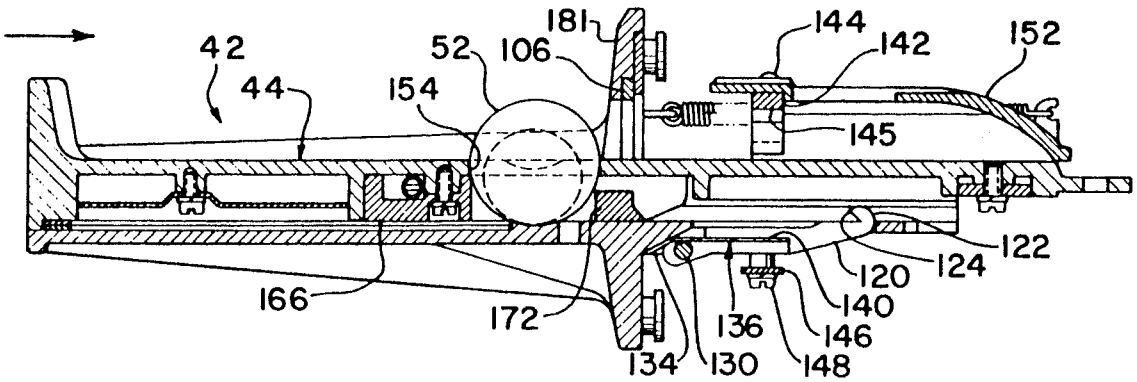
FIG. 12 is a longitudinal sectional view of the coin chute assembly showing the coin slide positioned in the coin chute housing in its retracted coin receiving position, and with a coin received in the coin slide and disposed in a vertical or standing on edge position.

It is now apparent that upon inserted movement of coin slide 44 in the direction of the arrow shown in FIGS. 12 and 13, the appropriately sized coins 52 are first carried by the slide past plates 181 and 106, thereby to render the gate defined by said plates in its closed position. The coins 52 then are carried by the slide so as to ride onto the platform 132 of the associated blocking dog 120. As the coins 52 ride onto the respective platforms 132, the upper edge of each coin is received in and engages the associated one of the notches 146 causing the engaged coin to press down against the corresponding one of the blocking dogs 120 thereby to pivot the dog clockwise, as viewed in FIG. 14, and move said dog to its displaced non-blocking position to permit continued movement of coin slide 44 to its fully inserted position. It will further be appreciated that, with reference to FIG. 14, the distance between notch 145 and the platform 132 of the corresponding dog 120, when said dog is in its displaced position, is substantially equal to the diameter of the con 52 for which the corresponding one of the coin support slots 154 is sized.

A protective bar 146 extends across the bottom of the blocking dogs 120 and is secured to the undersurface of housing inner portion 221 by fasteners 148. The bar 146 is positioned to lie transversely of the dogs 120 and in the path of movement of the dogs to restrict displaced movement of the dogs beyond their non-blocking position. This serves to prevent distortion of any one of the spring fingers 140 associated with the dogs, as might otherwise occur if any such spring finger was stressed beyond its yield point due to excessive displaced movement of the associated blocking dog 120 significantly beyond its non-blocking position.

Still another feature of the invention provides for the portion of housing 121 located inward of sizing block 142A to curve downwardly to define a baffle 152 positioned above the inner end of guide track 141. Baffle 152 is positioned to engage the edges of coins 52 which are carried by coin slide 44 past the coin sizing mechanism upon inserted movement of the slide, and direct or push the coins down through the respective ones of the coin slots 154 as the said slots pass the inner end 154 of guide track 141. This illustrated more clearly in FIG. 15 which shows the sequential positioning of the coin 52 as it exits from the coin chute assembly 42.

Baffle 152 serves an additional feature in, once again, preventing persons from operating the mechanism while, at the same time, retrieving the coins 52 deposited in coin slots 154. For example, it is known that users try to obtain free use of the apparatus by causing the coins 52 to be taped or wedges in the respective slots 154 so as to be returned to the user upon retracted movement of the coin slide 44. The baffle 152 forces the taped coins 52 to break free of its associated slot 154 upon movement of the slide 44 to its fully inserted position. If the user tries to withdraw the slide 44 prior to its being moved to its fully inserted position, the interengagement of a pawl with a rack will prevent such retracted movement of the slide. If the user tries to retract the slide 44 after the coins 52 pass the sizing dogs 120, the coins will be a lower discharge position as shown in FIG. 15 by reason of engagement with baffle 152, and become wedged between the baffle and the inner end 154B of guide track 141 thereby to jam the slide 44 and restrict further retracted movement thereof.

While advantageous embodiments have been chose to illustrate the invention, it will be understood by those skilled in the art that various changes and modifications can be made therein without departing from the scope of the invention as defined in the appended claims.

I claim:

1. A slide extension for a coin control unit having a housing, a starting mechanism disposed within the housing, and a coin slide mounted in and extending outwardly from the housing and being movable inwardly and outwardly for reciprocation between an outermost position and an innermost position, the slide extension comprising:

engaging means for operatively engaging the starting mechanism during outward movement of the coin slide after inward movement of the coin slide to a predetermined position, said engaging means including a pivotal lever normally oriented in a substantially vertical position by gravity, and a stop located to abut against said pivotal lever during outward movement of the coin slide and after said pivotal lever engages the starting mechanism which pivots said pivotal lever from its normal vertical position to a nonvertical position before activating the starting mechanism; and means for connecting the engaging means to the coin slide for movement therewith.

2. A slide extension according to claim 1, further comprising an extension plate having a proximal end coupled to the coin slide and a distal end.

3. A slide extension according to claim 2, further comprising a mounting bracket connected to said distal end of said extension plate, said connecting means including a shoulder bolt mounted on said mounting bracket.

4. A slide extension according to claim 3, wherein said stop is formed on said mounting bracket.

5. A slide extension according to claim 3, wherein said mounting bracket includes a first vertically downwardly oriented leg having an opening through which said shoulder bolt extends, and a second leg having a horizontal portion forming said stop for said pivotal lever.

6. A slide extension according to claim 5, wherein said second leg of said mounting bracket includes a vertical portion spaced outwardly from said first leg, and being in sliding contact with an inner surface of the housing to guide the coin slide during inward and outward movement thereof.

7. A coin control unit comprising:

a housing;

a starting mechanism disposed within said housing;

a coin slide mounted in and extending outwardly from said housing and being movable inwardly and outwardly for reciprocation between an outermost position and an innermost position to activate said starting mechanism in a single reciprocation of said coin slide, said coin slide having coin actuated blocking dogs movable from a blocking position to a non-blocking position and a coin discharge;

engaging means for operatively engaging said starting mechanism during outward movement of said coin slide to activate said starting mechanism after a single inward movement of said coin slide to a predetermined position, said engaging means including a first contact surface facing in the direction of outward movement of said coin slide for engaging said starting mechanism during a predetermined length of outward movement of a single reciprocation of said coin slide to activate said starting mechanism, said first contact surface being positioned relative to said starting mechanism and said blocking dogs to activate said starting mechanism after said predetermined length of outward movement of said coin slide causes said blocking dogs to move into the blocking position preventing further inward movement of said coin slide, and a second contact surface facing in the direction of inward movement of said coin slide for engaging said starting mechanism during a predetermined length of inward movement of a single reciprocation of said coin slide without activating said starting mechanism, said second contact surface being positioned relative to said starting mechanism and said coin discharge of said coin slide to permit said first contact surface to activate said starting mechanism during said predetermined length of outward movement only after said predetermined length of inward movement of said coin slide causes the coin to discharge from it initial position in said coin slide to a position preventing removal of the coin during subsequent outward movement of said coin slide; and means for connecting said engaging means to said coin slide for movement therewith, and for positioning said first contact surface and said second contact surface relative to the starting mechanism.

8. A coin control unit according to claim 7, wherein said engaging means includes a pivotal lever and a stop positioned to abut said pivotal lever when said lever pivots in one direction.

9. A coin control unit according to claim 8, further comprising an extension plate having a proximal end coupled to said coin slide and a distal end.

10. A coin control unit according to claim 9, further comprising a mounting bracket connected to said distal end of said extension plate, said connecting means including a shoulder bolt mounted on said mounting bracket.

11. A coin control unit according to claim 10, wherein said stop is formed on said mounting bracket.

12. A coin control unit according to claim 10, wherein said mounting bracket includes a first vertically downwardly oriented leg having an opening through which said shoulder bolt extends, and a second leg having a horizontal portion forming said stop for said pivotal lever.

13. A coin control unit according to claim 12, wherein said pivotal lever is normally oriented vertically by gravity and is acutely angled when said stop engages said lever.

14. A coin control unit according to claim 13, wherein said second leg of said mounting bracket includes a vertical portion spaced outwardly from said first leg, and being in sliding contact with an inner surface of said housing to guide said coin slide during inward and outward movement thereof.

15. A coin control unit according to claim 7, wherein said starting mechanism includes a switch and a ratchet having a reciprocating lever movable between a return position and a switch activating position by said engaging means.

16. A coin control unit according to claim 15, wherein said engaging means comprises an extension plate having first and second spaced apart legs, said reciprocating lever being movable to said return position by said first leg and to said switch activating position by said second leg.

17. A slide extension assembly adapted to be coupled to a coin slide for movement therewith, comprising:

engaging means for operatively engaging a starting mechanism in a control unit during outward movement of the coin slide after inward movement of the coin slide to a predetermined position, said engaging means including a pivotally mounted lever with a substantially normal vertical position for inoperatively engaging the starting mechanism during inward movement of the coin slide to pivot said lever in a first direction from its vertical position, and operatively engaging the starting mechanism during outward movement of the coin slide only after outward movement of the coin slide to a predetermined position causes said lever to pivot in a second direction from its vertical position to a nonvertical position before moving the starting mechanism, said lever having a first contact surface facing in the direction of outward movement of the coin slide when coupled to the coin slide for operatively engaging the starting mechanism, and a second contact surface facing in the direction of inward movement of the coin slide when coupled thereto; and coupling means for connecting said engaging means to the coin slide for movement therewith.

18. A slide extension assembly according to claim 17, wherein said engaging means further includes a stop for limiting pivotal movement of said lever during outward movement of the coin slide after operative engagement with the starting mechanism.

19. A slide extension assembly according to claim 18, further comprising an extension plate having said engaging means coupled at one end and the coin slide adapted to be coupled at the other end.

20. A coin control unit comprising:

a housing;

a starting mechanism disposed within said housing;

a coin slide mounted in and extending outwardly from said housing and being movable inwardly and outwardly for reciprocation between an outermost position and an innermost position;

engaging means for operatively engaging said starting mechanism during outward movement of said coin slide after inward movement of said coin slide to a predetermined position, said engaging means including a pivotally mounted lever normally oriented in a substantially vertical position by gravity, and a stop positioned to abut against said pivotal lever during outward movement of the coin slide only after said pivotal lever engages said starting mechanism which pivots said pivotal lever from its normal vertical position to a nonvertical position before activating said starting mechanism; and means for connecting said engaging means to said coin slide for movement therewith.

21. A coin control unit according to claim 20, further comprising an extension plate having a proximal end coupled to said coin slide and a distal end.

22. A coin control unit according to claim 21, further comprising a mounting bracket connected to said distal end of said extension plate, said connecting means including a shoulder bolt mounted on the mounting bracket.

23. A coin control unit according to claim 22, wherein said stop is formed on said mounting bracket.

24. A coin control unit according to claim 22, wherein said mounting bracket includes a first vertically downwardly oriented leg having an opening through which said shoulder bolt extends, and a second leg having a horizontal portion forming said stop for said pivotal lever.

25. A coin control unit according to claim 24, wherein said second leg of said mounting bracket includes a vertical portion spaced outwardly from said first leg, and being in sliding contact with an inner surface of said housing to guide said coin slide during inward and outward movement thereof.

26. A method of operating a coin operated device with a starting mechanism in a single reciprocation of a coin slide, comprising the steps of inserting at least one coin into the coin slide of a coin chute assembly having a slide extension assembly, a coin discharge and coin actuated blocking dogs movable from a blocking position to a non-blocking position, moving the coin slide with the coin therein inwardly to an inner position causing a first contact surface of the slide extension to engage the starting mechanism and the coin to move from its initial position to a discharge position preventing removal of the coin by subsequent outward movement of the coin slide; and moving the coin slide and the slide extension assembly outwardly to an outer position causing a second contact surface of the slide extension to operatively engage the starting mechanism and to move a lever of the starting mechanism to activate the starting mechanism in a single reciprocation of the coin slide after the blocking dogs of the coin chute assembly move into the blocking position preventing further inward movement of the coin slide.

* * * * *